United States Patent [19]

Sorenson et al.

[11] Patent Number: 4,694,966

[45] Date of Patent: Sep. 22, 1987

[54] MERCHANDISING TRAY

[75] Inventors: Robert E. Sorenson, Comstock Park, Mich.; John M. Scriba, Jr., Western Springs, Ill.

[73] Assignee: Knape & Vogt Manufacturing Co., Grand Rapids, Mich.

[21] Appl. No.: 886,326

[22] Filed: Jul. 17, 1986

[51] Int. Cl.[4] ..... A47F 5/08

[52] U.S. Cl. ..... 211/88; 211/181

[58] Field of Search ..... 211/88, 59.2, 181, 90, 211/106, 71, 126, 57.1, 59.1

[56] References Cited

U.S. PATENT DOCUMENTS

| | | | |
|---|---|---|---|
| 2,272,524 | 2/1942 | Johnson | 211/181 X |
| 3,973,678 | 8/1976 | Nesbitt | 211/181 X |
| 4,072,246 | 2/1978 | Paulin | 211/57.1 X |
| 4,248,352 | 2/1981 | White | 211/106 X |
| 4,511,047 | 4/1985 | Elinsky | 211/90 |

*Primary Examiner*—Ramon S. Britts
*Assistant Examiner*—Sarah A. Lechok Eley
*Attorney, Agent, or Firm*—Price, Heneveld, Cooper, DeWitt & Litton

[57] ABSTRACT

A display tray for attachment to a perforated support panel, formed of interconnected wires in planes forming a bottom, a rear and sides, the bottom wires extending forwardly in the form of upwardly projecting hairpins, a pair of the bottom wires extending diagonally up and rearwardly and terminating as offset ends for insertion into the support panel. Downwardly rearwardly protruding compression wires are insertable in the support panel to brace the tray.

5 Claims, 4 Drawing Figures

MERCHANDISING TRAY

BACKGROUND OF THE INVENTION

This invention relates to display trays for merchandise or literature, and particularly to a display tray for cantilever suspension attachment to a perforated support panel.

Hanging support of articles on perforated display panels is commonly achieved with the use of hooks, loops, etc. in well known fashion. Such devices are employed as display racks in stores, tool racks at home or in shops, et al.

SUMMARY OF THE INVENTION

This invention provides a novel display tray attachable in cantilever fashion to a perforated vertical support panel. The tray is formed of steel wires. The first set of wires forms the bottom, the back, and front retention hairpins, as well as the tensile attachment elements to the panel. A peripheral wire forms the lateral sides as well as being joined to the first set of wires. Diagonal brace wires form compressive bracing support.

The novel structure projects diagonally downwardly and forwardly from the support panel, to display merchandise, literature or the like.

DESCRIPTION OF THE PREFERRED EMBODIMENT

Figure 1:
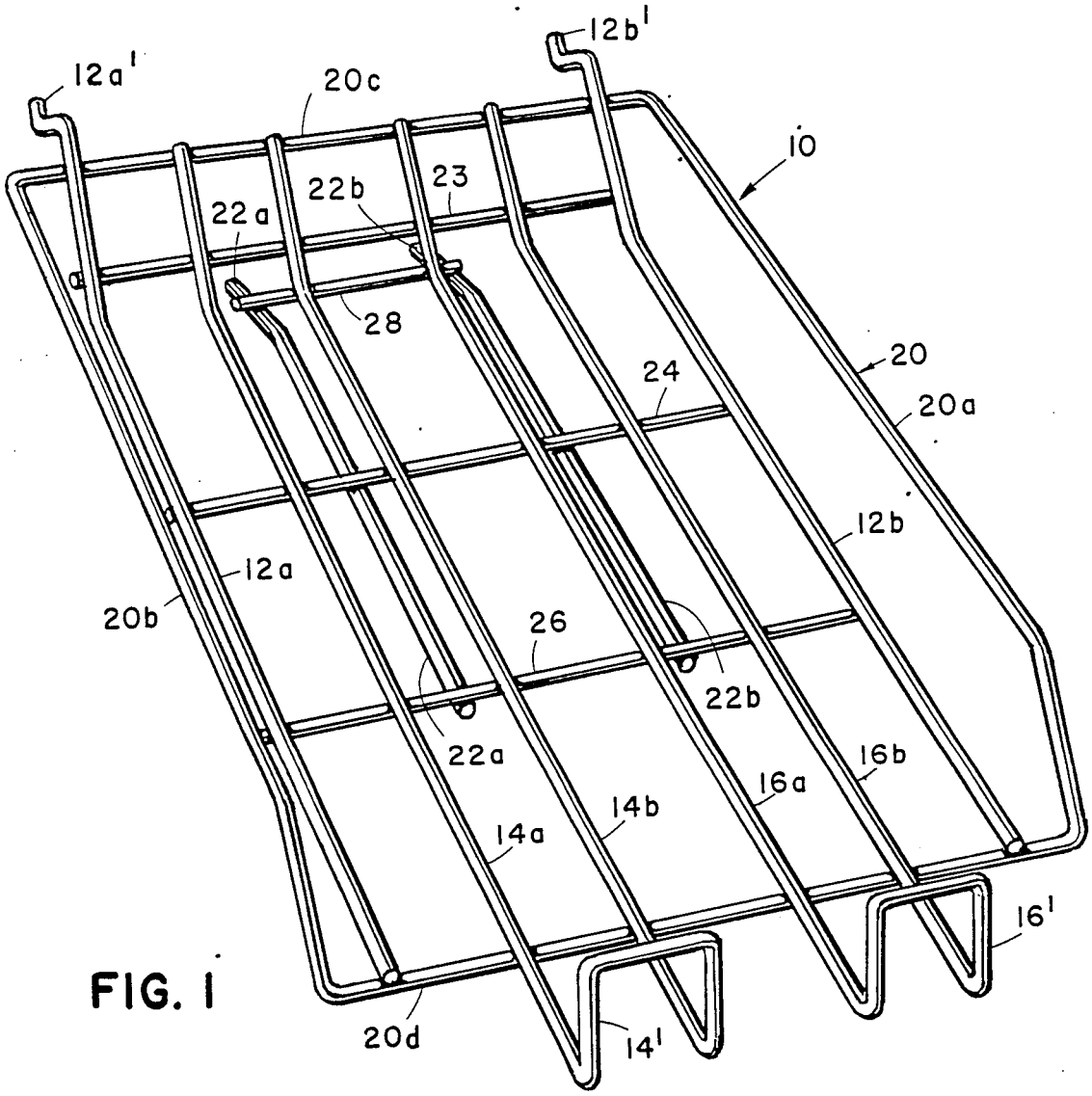
FIG. 1 is a perspective view of the invention.
Figure 2:
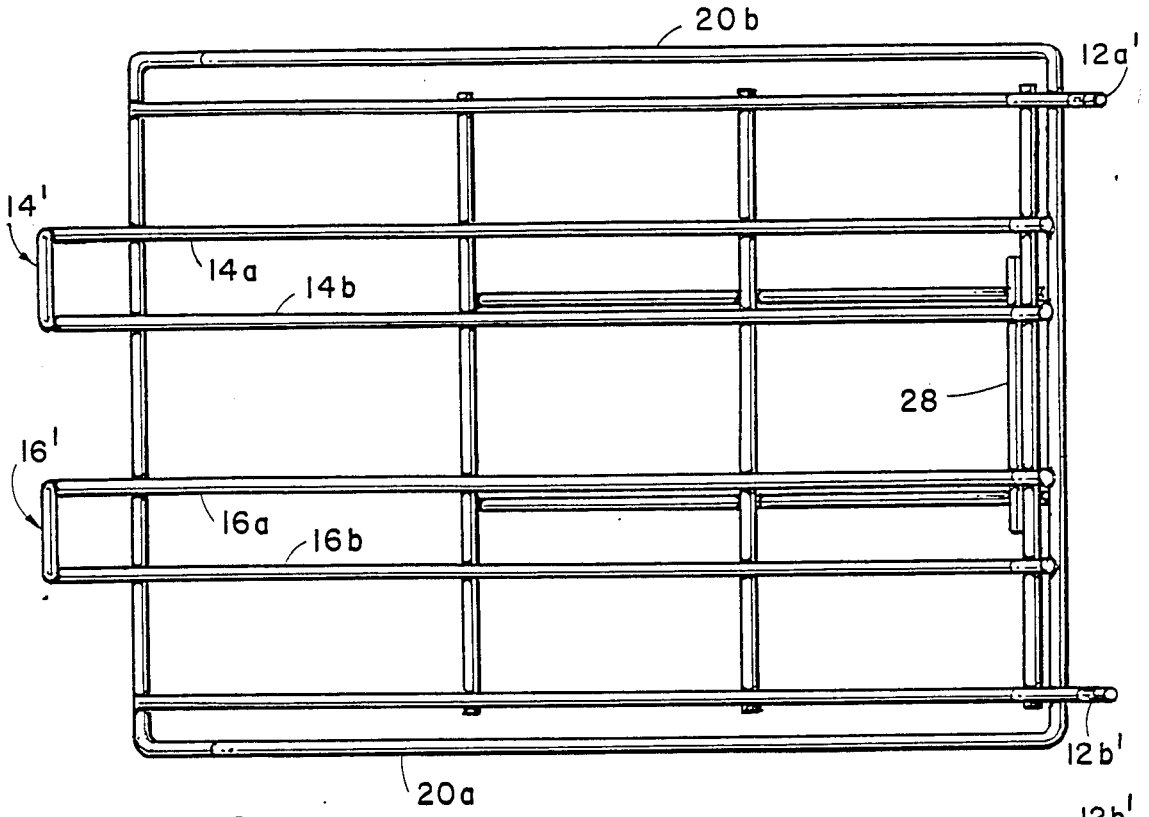
FIG. 2 is a top plan view of the invention.
Figure 3:
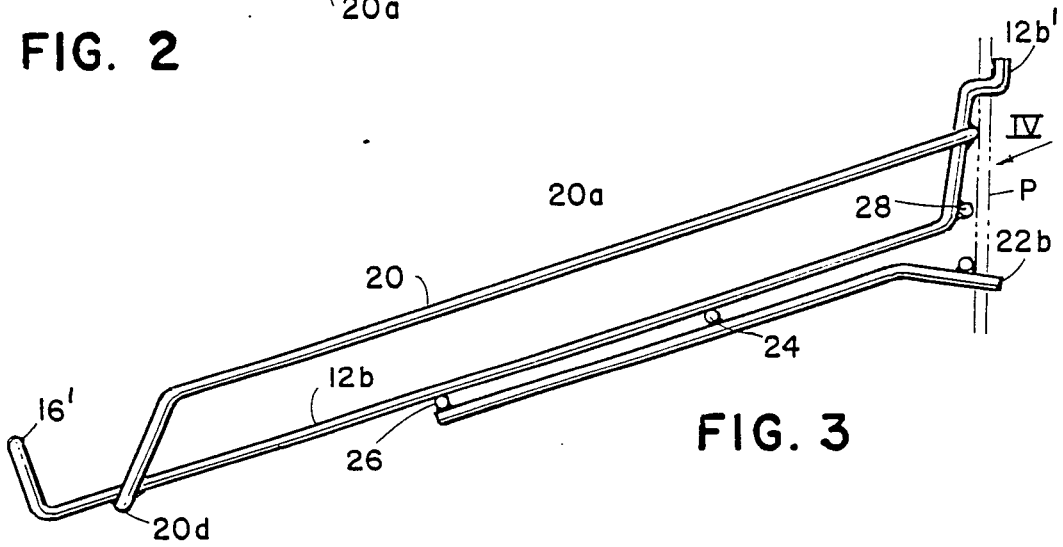
FIG. 3 is a side elevational view of the invention.
Figure 4:
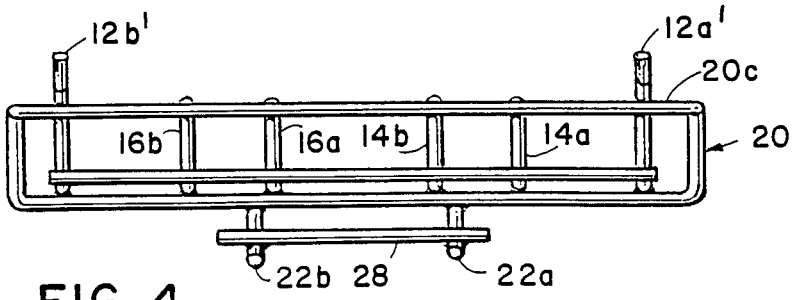
FIG. 4 is a rear view of the tray.

Referring now specifically to the drawings, the novel tray 10 is formed entirely of a plurality of wire elements. It is to be suspended from a vertical perforated support panel P, basically in a diagonally downwardly-forward orientation as depicted in FIGS. 1 and 3. A first set of wires 12*a*, 14*a* and 14*b*, 16*a* and 16*b*, and 12*b* is arranged in spaced parallel arrangement in one plane forming the bottom of the tray. The rear portions of these wires extend diagonally rearwardly and upwardly in a second plane which is obtuse to the plane of the tray bottom. Two of the wires extend further than the others, specifically the outer two, 12*a* and 12*b*. The rear ends are offset in L-shaped fashion at 12*a*′ and 12*b*′ to be inserted through holes in the perforated support panel and bear against the inner surface of the panel.

Wires 14*a* and 14*b* and 16*a* and 16*b* protrude downwardly forwardly beyond the remainder of the wires, and then extend upwardly to form hairpins 14′ and 16′ i.e., the two wires are joined in a U-shaped junction (FIG. 1) like a hairpin.

A peripheral border wire 20 extends around the tray, forming the lateral sides and joined to the above noted support wires at the rear and front of the tray. More specifically, the peripheral border wire 20 includes side portions 20*a* and 20*b*, the rear transverse portion 20*c* and the front transverse portion 20*d*. The rear transverse portion 20*c* is joined by welding to the upper ends of support wires 14*a* and 14*b*, 16*a* and 16*b*, and 12*a* and 12*b*. The front portion 20*d* is also joined by welding to these supports. The hairpins extent downwardly and forwardly, i.e., are below and in front of, the front transverse portion 20*d*. The lateral portions 20*a* and 20*b* lie in the same plane as rear portion 20*c*, parallel to the plane of the bottom of the tray. The front ends of 20*a* and 20*b* extend downwardly between the two planes to front portion 20*d*.

A pair of downwardly-rearwardly projecting compression brace wires 22*a* and 22*b* have exposed rear ends 22*a*′ and 22*b*′ for engaging in holes of the vertical support panel. These wires are welded to a pair of transverse reinforcing wires 24 and 26, which in turn are joined by welding to the undersurface of the support wires forming the tray bottom. Another transverse wire 23 is used to join these support wires at the diagonal rear of the shelf. A shorter transverse wire 28 extends between the bracing wires 22*a* and 22*b* a fraction of an inch from the rear ends of the wires to form a shoulder that limits insertion of these wires into the holes of the support panel. This wire 28 bears against the front face of the panel.

In use, the tray can be employed to retain merchandise, literature, or the like by attaching it to vertical support panel P (FIG. 3) shown in phantom. That is, the upper terminal ends of the offset portions 12*a*′ and 12*b*′ of support wires 12*a* and 12*b* are inserted through a pair of holes in panel P, so that the offset bears against the inner face of the panel, and the tray is tilted downwardly until ends 22*a* and 22*b* are inserted into a pair of lower holes in the panel. Transverse wire 28 thus abuts against the front face of the panel. The tray is thus held in cantilever fashion. Removal of the tray is also readily accomplished by simply lifting up on the outer end until portions 22*a* and 22*b* are retracted from the respective holes such that further lifting and withdrawal of upper ends 12*a*′ and 12*b*′ from their respective holes releases the tray.

Conceivably, minor variations could be made in the specifically described embodiment of the invention, while still incorporating the novel aspects thereof. Consquently, it is intended that the invention should be limited only by the scope of the appended claims and the reasonably equivalent structures to those defined therein, rather than to the preferred embodiments set forth herein.

The embodiments of the invention in which an exclusive property or privilege is claimed are defined as follows:

1. A tray for attachment to a perforated vertical support panel comprising:

a plurality of article support wires arranged in spaced, generally parallel planar array to form a tray bottom in a first plane, said support wires having rear portions projecting diagonally upwardly in a second plane obtuse to said first plane;

a pair of said support wires having offset rear terminal ends to project into perforations of the support panel;

a peripheral border wire extending around the tray, with two lateral portions, a front transverse portion and a rear transverse portion, said lateral portions and said rear portion being in a third plane elevated above said first plane, said rear portion being joined by welding to said support wire rear portions;

said first mentioned support wires having front portions joined by welding to said front transverse portion of said peripheral border wire, with at least some of said support wires extending forwardly beyond said border wire, and terminating in upwardly extending hairpins;

and compression brace wires extending downwardly rearwardly with respect to said tray bottom, being joined by welding to said tray bottom, and having rearwardly protruding ends for insertion in holes in the support pannel, said brace wires having depth limiting shoulder means for limiting the depth of insertion of said brace wires into the support panel.

2. The tray in claim 1 wherein said third plane is generally parallel to said first plane.

3. The tray in claim 1 wherein said hairpins are of inverted U-shaped configuration.

4. The tray in claim 1 wherein said shoulder means comprises a wire transverse to and joined by welding to said brace wires.

5. The tray in claim 1 wherein said compression brace wires extend from said bottom of said tray.

* * * * *